United States Patent [19]

Mitchell

[11] 3,993,060

[45] Nov. 23, 1976

[54] DIVING SNORKEL WITH CONVOLUTED TUBE

[75] Inventor: Wallace F. Mitchell, Mettawa, Ill.

[73] Assignee: Dacor Corporation, Northfield, Ill.

[22] Filed: Dec. 11, 1974

[21] Appl. No.: 531,454

[52] U.S. Cl. ..... 128/145 A; 138/121

[51] Int. Cl.[2] ..... A62B 7/12

[58] Field of Search ..... 128/140, 145 A, 145 R, 128/142, 142.2, 142.3, 142.4; 138/118, 119, 121, 122, 177; 244/1 R

[56] References Cited

UNITED STATES PATENTS

| | | | |
|---|---|---|---|
| 1,901,219 | 3/1933 | Belcher | 128/145 A |
| 2,189,207 | 2/1940 | Heath | 138/121 |
| 3,043,612 | 7/1962 | Pavlik et al. | 138/121 |
| 3,047,026 | 7/1962 | Kahn | 138/121 |
| 3,345,984 | 10/1967 | Katehis | 128/145 R |
| 3,603,306 | 9/1971 | Bonin, Jr. | 128/145 A |
| 3,858,615 | 1/1975 | Weigl | 138/118 |

*Primary Examiner*—William E. Kamm
*Attorney, Agent, or Firm*—Edmond T. Patnaude

[57] ABSTRACT

A diving snorkel has a flexible, tubular section having a substantially smooth inner surface to permit laminar air flow therethrough.

5 Claims, 3 Drawing Figures

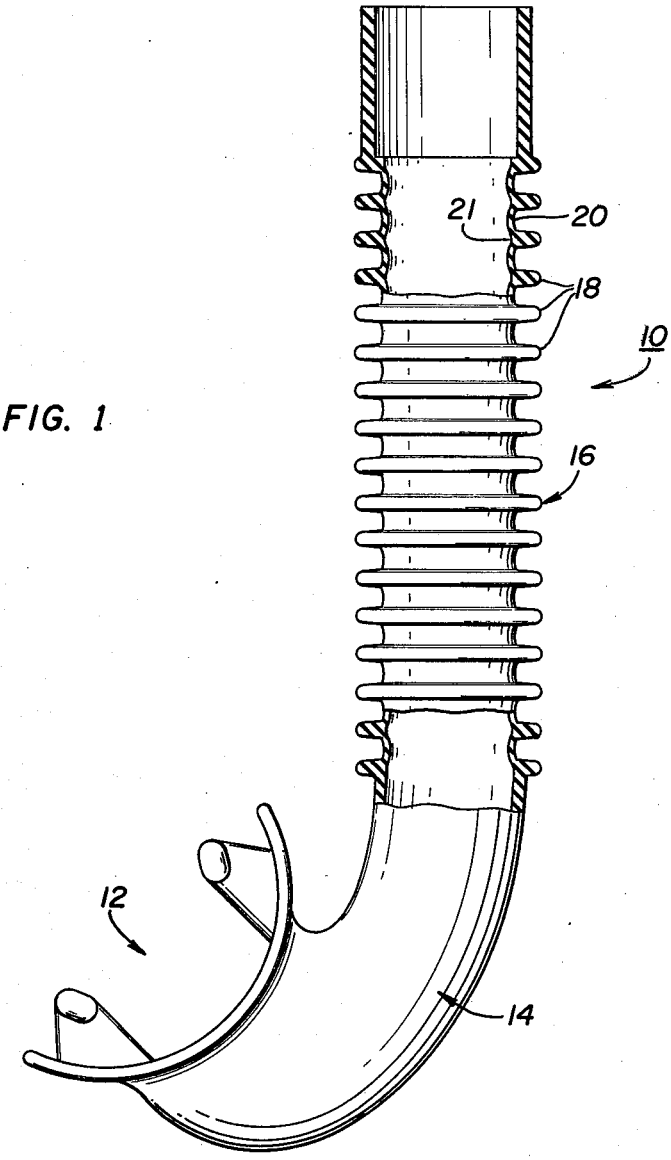
FIG. 1
FIG. 2
PRIOR ART
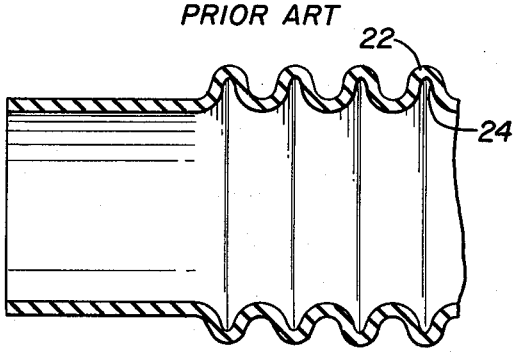
FIG. 3
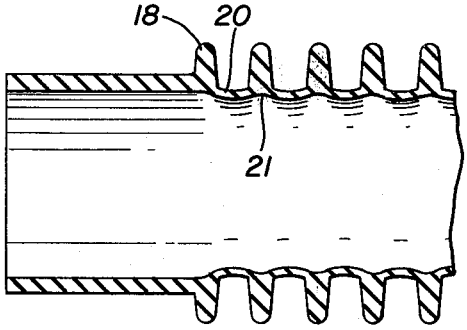

DIVING SNORKEL WITH CONVOLUTED TUBE

The present invention relates in general to diving snorkels and in particular to a diving snorkel having a flexible section through which air flows in laminar condition.

BACKGROUND OF THE INVENTION

Diving snorkels commonly have a mouthpiece connected to one end of a tube which extends around the diver's face to a location above his head where the tube is open. Such a snorkel permits a diver to breathe while his face is submerged in water a short distance below the surface. Preferably the tubular body portion of the snorkel is flexible so that the snorkel feels comfortable to the diver while strapped to his head. Convoluted rubber tubes have been used for this purpose but the internal annular grooves are a source of trouble in that they provide water and saliva traps in which bacteria flourish. Also, these internal grooves cause turbulence in the water stream therethrough making clearing of the snorkel more difficult than with snorkels having straight smooth walled tubes, and breathing is also substantially more difficult with the prior art convoluted snorkel tubes.

A further problem with the prior art convoluted snorkel tubes is that it is impossible for a diver to completely clear the tube of water by blowing through the tube. Consequently, the small amount of water thus collected in the convolution tends to slowly drip into the mouth of the diver causing an unpleasant sensation at best and gagging at worst.

SUMMARY OF THE INVENTION

Briefly, in accordance with the present invention there is provided an integrally molded snorkel formed of rubber and having a mouthpiece and a flexible section with a substantially smooth inner wall and external annular ribs spaced apart by thin walled intermediate sections. The thin walled intermediate sections provide flexibility to permit bending of the snorkel tube while the solid ribs prevent collapsing of the tube when it is bent. In addition, the ribs protect the thin walled sections from external damage.

BRIEF DESCRIPTION OF THE DRAWING

Further objects and advantages and a better understanding of the present invention can be had by reference to the following detailed description wherein:

FIG. 1 is an elevational view, partly in section, of a diving snorkel embodying the present invention;

FIG. 2 is a fragmentary, longitudinal sectional view of a prior art convoluted snorkel tube; and FIG. 3 is a fragmentary sectional view of the flexible section of the diving snorkel of FIG. 1.

DETAILED DESCRIPTION OF THE INVENTION

Referring to the drawing and particularly to FIG. 1 thereof, a diving snorkel 10 is a unitary member molded of rubber and has a mouthpiece section 12 adjoining a tubular section 14 which in turn adjoins a tubular flexible section 16. The tubular section 14 is substantially rigid while the section 16 is flexible so as to permit bending of the snorkel tube to fit closely along side the head of the diver using the snorkel.

In accordance with the present invention the flexible section 16 comprises a plurality of solid annular externally extending ribs 18 spaced apart by relatively thin intermediate wall sections 20. The longitudinal length of the wall sections 20 is slightly greater than the base thickness of the ribs 18. The wall sections 20 are slightly convex on the inner side so the interior wall of the section 16 is not precisely cylindrical but is sufficiently close thereto such that laminar flow of water and air through the snorkel tube occurs during use of the snorkel. As shown in FIG. 3, the depth of the internal annular grooves 21 is no greater than the thickness of the intermediate wall sections 20 and they have a smooth rounded surface to provide a very shallow, generally sinusoidal surface for the flexible tube section. While a cylindrical inner surface would provide minimum resistance to fluid flow therethrough, I have found that such a tube tends to collapse when bent. The concavo-convex intermediate wall sections 20 are provided to avoid the collapsing problem and if the resulting grooves are sufficiently smooth and shallow, the increased resistance to fluid flow is not significant and laminar fluid flow occurs.

In FIG. 2 there is shown a typical convoluted tube 22 which has in the past been used to provide flexibility in diving snorkels and other devices. The tube 26 has a plurality of relatively deep internal annular grooves 24 which trap saliva, bacteria and other material when the snorkel is in use. Moreover, the deep grooves 24 cause turbulence in the fluid flow through the snorkel tube making use thereof difficult. Comparative tests of flexible tubes constructed in accordance with the present invention as shown in FIG. 3 and with the prior art tube of FIG. 2 show that for use in breathing, the tubular construction of the present invention makes it 70% easier to breathe than with the prior art flexible tubular section of FIG. 2. These tests were made with an air flow through the snorkel tube of 10 cfm. Likewise, water can be cleared from the snorkel tube of FIG. 3 at a 15% faster rate than from the tube of FIG. 2, based on a flow of 200 gallons of water.

While the present invention has been described in connection with a particular embodiment thereof, it will be understood by those skilled in the art that many changes and modifications may be made without departing from the true spirit and scope of the present invention. Therefore, it is intended by the appended claims to cover all such changes and modifications which come within the true spirit and scope of the invention.

What is claimed:

1. A diving one-piece molded rubber snorkel, comprising a one-piece molded rubber conduit, a mouthpiece formed at one end of said conduit, an intermediate flexible snorkel tube section, said tube section including a plurality of solid rubber annular external ribs spaced apart by intermediate annular wall sections, said wall sections being concavo-convex in cross-section with the external surface being concave, and the interior surface of said tube being smooth to permit laminar fluid flow therethrough.

2. A diving snorkel according to claim 1 comprising a substantially rigid tubular section interconnected between said mouthpiece and said flexible snorkel tube, said rigid tubular wall section having a wall thickness substantially greater than that of said intermediate wall sections.

3. A diving snorkel according to claim 1 wherein the interior wall of said flexible snorkel tube is generally sinusoidal.

4. A diving snorkel according to claim 3 wherein the longitudinal dimension of each of said intermediate sections is greater than the base thickness of each of said ribs.

5. A diving snorkel according to claim 4 wherein each of said ribs has a shallow internal groove having a depth less than the thickness of said intermediate wall sections.

* * * * *